US006084487A

United States Patent [19]

Hoffman

[11] Patent Number: 6,084,487

[45] Date of Patent: Jul. 4, 2000

[54] HELICAL FILTER WITH A REMOVABLE TAP HOUSING

[76] Inventor: Mark Allan Hoffman, 11250 Corte Playa Corona, San Diego, Calif. 92124

[21] Appl. No.: 09/200,914

[22] Filed: Nov. 27, 1998

[51] Int. Cl.[7] ..... H01P 1/201

[52] U.S. Cl. ..... 333/202; 333/219

[58] Field of Search ..... 333/202, 219

[56] References Cited

U.S. PATENT DOCUMENTS

| | | | |
|---|---|---|---|
| 3,691,487 | 9/1972 | Yoshimoto | 333/202 |
| 4,061,992 | 12/1977 | Inokuchi | 333/202 |
| 4,210,884 | 7/1980 | Tabuchi et al. | 333/203 |
| 4,385,279 | 5/1983 | Meador | 333/202 X |
| 4,682,131 | 7/1987 | May | 333/202 |
| 5,066,932 | 11/1991 | Takada et al. | 333/202 |
| 5,157,363 | 10/1992 | Puurunen et al. | 333/202 |
| 5,629,266 | 5/1997 | Lithgow et al. | 333/202 X |

FOREIGN PATENT DOCUMENTS

| | | | |
|---|---|---|---|
| 4124924 | 2/1992 | Germany | 333/202 HC |
| 58-24201 | 2/1983 | Japan | 333/202 HC |
| 2-050502 | 2/1990 | Japan . | |
| 3-234101 | 10/1991 | Japan | 333/202 HC |

*Primary Examiner*—Justin P. Bettendorf

[57] ABSTRACT

A high frequency filter kit in which resonating first and second electrical circuits are enclosed between proximal and distal ends of a filter case. Partitioning the inside of the enclosed resonant circuits may be performed by a user to form at least a first cavity and a second cavity. The first resonating circuit is then disposed inside the first cavity of the filter case extending from the proximal end towards the distal end, and the second resonating circuit is disposed inside the second cavity also extending from the proximal end towards the distal end. Electrical signals are coupled into the resonating circuits by an encased signal coupler which is removably mounted by a coupling housing for supporting the signal coupler at the proximal end of the filter case for positioning in the vicinity of the resonating circuits. The kit thus facilitates enhanced turnout time and communication of design specifications for manufacture by specifying the basic components required to build the specific high frequency filter, allowing the user to build prototype filters that may be used for manufacturing a RF/microwave system or be provided as a sample to the filter manufacturers.

24 Claims, 4 Drawing Sheets

FIG. 1
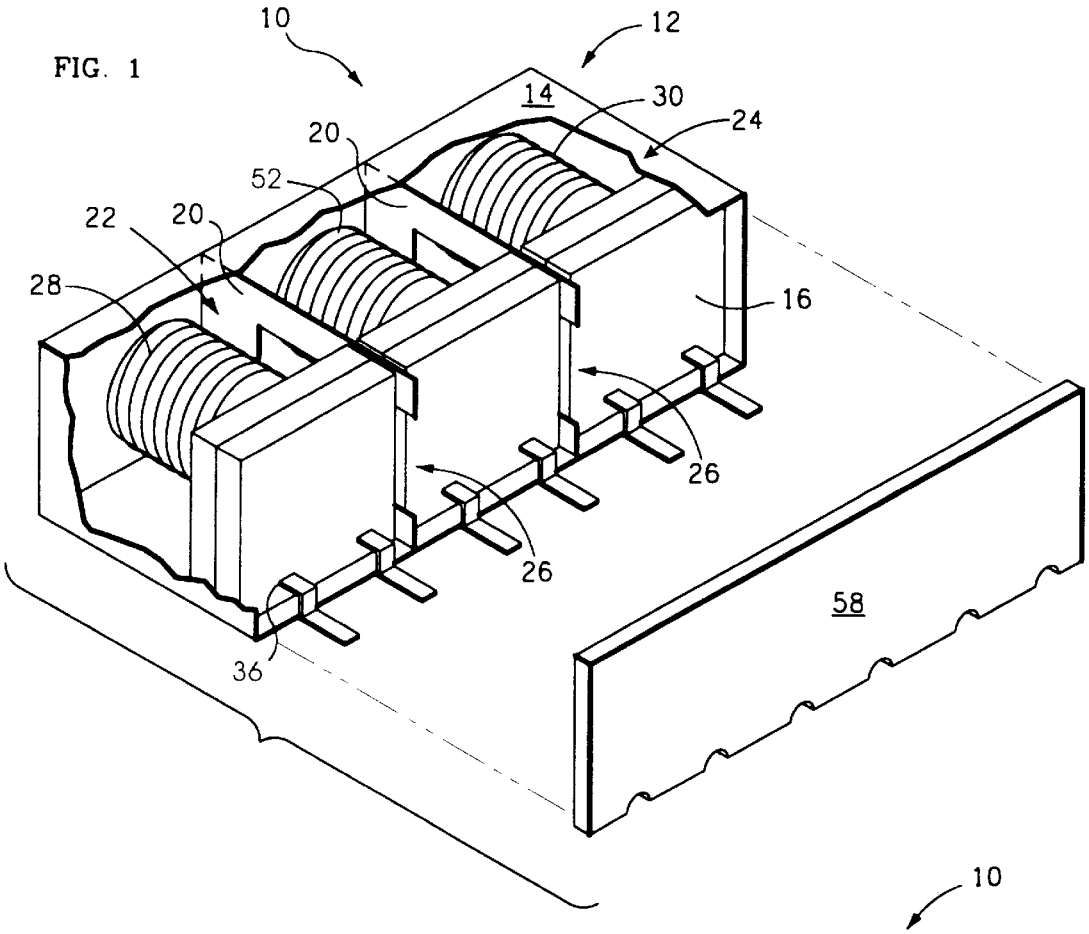
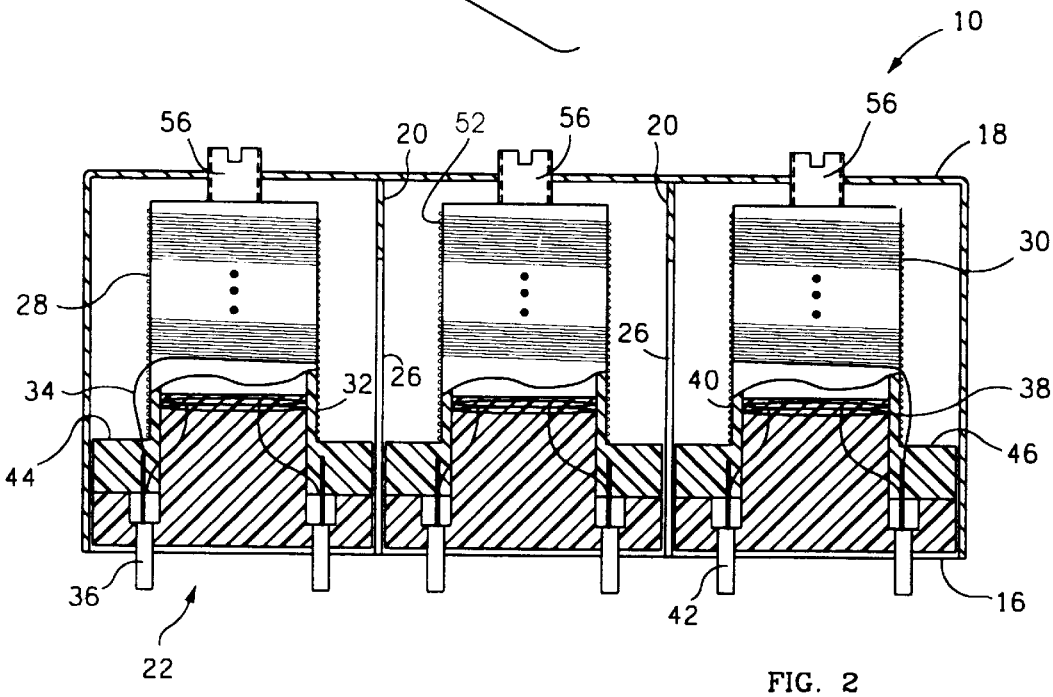
FIG. 2

FIG. 3a
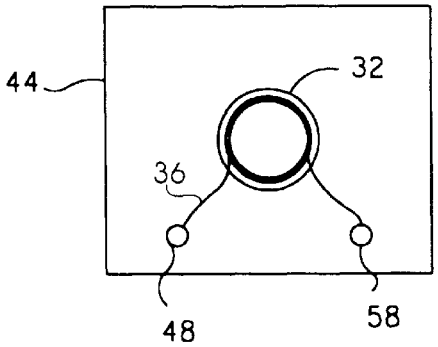
FIG. 3b
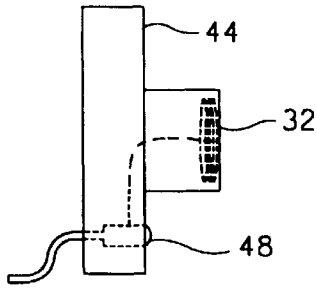
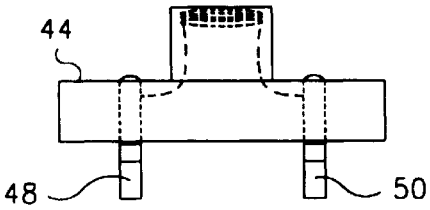
FIG. 3c
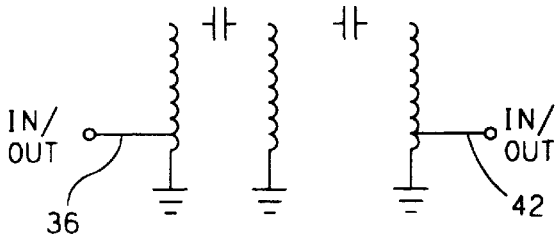
FIG. 4
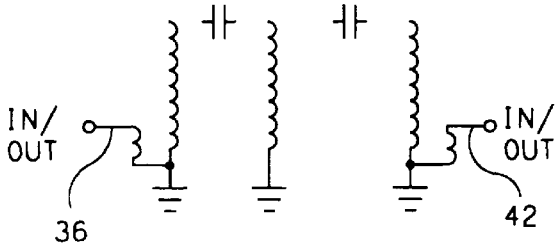
FIG. 5
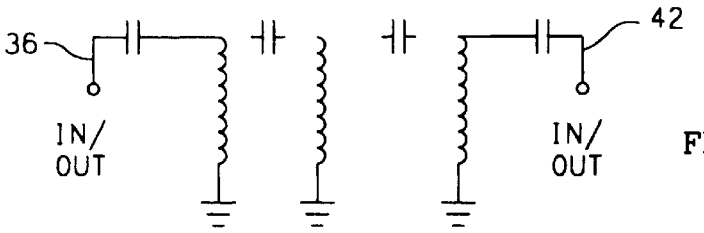
FIG. 6

HELICAL FILTER WITH A REMOVABLE TAP HOUSING

BACKGROUND OF THE INVENTION

1. Field of the Invention

The present invention relates to RF and microwave filters, and more particularly to simplifying the filter design and prototype processes.

2. Description of the Related Art

Presently, RF and microwave filters (RFMF) are used extensively in most communication devices, radar and RF/microwave systems. They are used to create the desired RF or microwave output signal—free of unwanted spurious signals and with the proper output characteristics. RF/microwave telecommunication equipment manufacturers use millions of these filters per year. These filters are used in cellular basestations, satellite communication systems and microwave communication links to name a few typical applications. RFMF components are either made internally by the equipment manufacturer or procured externally. Most of the time these filters are procured because the required filter specifications are often difficult to manufacture, and thus many companies specialize in making RFMF designs. Such filters range in frequency from ~5 MHz to 100 GHz, usually in the 200 MHz to 4 GHz range. Some companies focus a great deal into military systems while, others focus on commercial pro/ducts. Many different types of filters are made by these companies including dielectric filters (using conductivity coated ceramic blocks), LC filters, comb filters, notch filters, helical filters, coupled cavity filters and the like. Most companies make custom filters but have a catalog of standard filters. Some companies, but not many, have many standard filters. Most companies and their distributors do not stock standard filters.

Engineers using filters usually write their own specifications so that a company can submit a design proposal. Some companies have software to help engineers specify and define filters. If the engineer likes the proposal they request or buy samples from the manufacturers they prefer. This process generally takes four to twelve weeks. When the engineer gets the RFMF, he tests it and sometimes makes changes to the requirement and the process continues, thus sometimes the system requirements change as the design progresses. Spurious signals become apparent and they have to be reduced, e.g., by RF emission testing (per FCC criteria) which may require different filter characteristics etc. Accordingly the process may require about one to six months to complete. If the filters, however, are not too difficult to make and the cost is a major consideration the filters are sometimes made internally using standard inductors and capacitors, or by on board techniques such as microstrip coupled lines. Some companies sell variable filters which can tune over a wide range of frequencies, however these filters are expensive, large, connectorized and thus for most situations can not be used in prototype systems.

There are numerous shortcomings associated with existing filter design practices, such as design time, lack of flexibility, difficulty in communicating needs, and various difficulties associated with simulating and building prototypes. First, as discussed above this process can take up to six months or more to build and test a desired filter design. Alternatively, the circuit designer may use commercially available parts, but must then contend with the attendant lack of flexibility and availability of a particular filter characteristic. Thus the engineer must modify their circuit design to accommodate the use of the limited number of readily available filters. To this end, one must take what is given and can not change many times because of the cost and time constraints associated with standard and custom filters.

Secondly, many times difficulty arises in communicating the engineers exact filter requirements because the systems are often so complex that it is difficult to communicate every specification which is required. For example, the filter manufacturing company might build the filter for a 50 ohm load but what is actually needed is a different impedance. Often the engineer does not know exactly what he really wants until the system is put together. As a result the filter maybe incorrectly specified.

Furthermore, difficulty occurs in simulating a circuit or system because of the lack of exact information on the filter. Many other components such as amplifiers, attenuators, switches are well characterized by the manufacturers and their S-parameters can be put into computer programs that simulate the circuit or system accurately. Filters also present a design problem because many times the engineer does not know the exact response or impedance requirement until the engineer receives the actual part from which components are characterized to extract the S-parameters. Some system simulators only require the passband, rejection and group delay of the filter, but more detailed circuit simulators require S-parameters or an equivalent circuit.

Finally, filters are often the rate determining step when building a RF/microwave system and many times present the most significant difficulty to building the system quickly. Other components such as amplifiers, attenuators, switches and mixers are broadband such that standard product will be available in short notice from many manufacturers and distributors. Filters are generally not broadband and are by definition frequency specific. With the exception of some standard telecommunications frequency filters, most are typically not held in stock because of their specialized nature. Many times engineers desire to modify a standard filter's characteristics such as bandwidth, rejection, ripple, impedance, etc.

Numerous problems are associated with building experimental high frequency filters on test boards. They include a lack of performance due to low Q components and board type restrictions, tuning requirements, as well as the time required to build and test the filter design. Generally a test board must be created, components must be characterized at required frequencies, and finally the filter must then be tested and tuned.

SUMMARY OF THE INVENTION

It is an object of the invention to overcome the existing filter problems of the prior art.

It is an object of the present invention to provide circuits and methods of making high frequency filters which may be designed and assembled in minutes instead of months.

It is another object of the invention to provide filters which can be optimized and well characterized before they are ever built.

It is yet another object of the present invention to provide filters that can be optimized in the real system for maximum performance and control.

It is a further object of the invention to provide cost effective filter designs through the use of readily available competitive components.

It is a still further object of the invention to provide for manufacture with enhanced turn around time and communication of design specifications that may use filter design software which specifies the basic components required to build the specific high frequency filter. Thus allowing the user to build prototype filters that may be provided as a sample to a filter manufacturer or given in the form of specifications of the existing filter.

In a described embodiment, a kit for assembling a high frequency filter includes a filter case having side walls, a generally open proximal end and a generally closed distal end. A partition within said filter case separates the inside of the filter case into at least a first cavity and a second cavity, the partition having an aperture for coupling the first and second cavities. A first helical resonator coil is disposed inside the first cavity of the filter case extending from the proximal end towards the distal end of the filter case, and a second helical resonator coil is disposed inside the second cavity of the filter case extending from the proximal end towards the distal end of the filter case.

A first tap coil is then provided as being connectable in series with the first helical resonator coil at the proximal end of the filter case, the series connection between the first helical resonator coil and the first tap coil providing an input tap for coupling electrical signals to the high frequency filter. A second tap coil is further connectable in series with the second helical resonator coil at the proximal end of the filter case, the series connection between the second helical resonator coil and the second tap coil providing an output tap for coupling electrical signals from the high frequency filter. A removable tap housing is provided for supporting the first tap coil at the proximal end of the filter case.

A method of assembling the high frequency filter thus provides a first coil for resonating first electrical signals, and a second coil for resonating second electrical signals. The first and the second coils are enclosed between a generally open proximal end and a generally closed distal end. Partitioning of the enclosed first and second coils provides a first cavity and a second cavity respectively. The first coil is disposed inside the first cavity extending from the proximal end towards the distal end, and the second coil is disposed inside the second cavity extending from the proximal end towards the distal end of the enclosure. A removable signal coupler provides coupling of electrical signals into the first coil, with the coupling tap being supported by a housing at the proximal end.

Briefly summarized, the present invention relates to filters and methods wherein resonating first and second electrical circuits are enclosed between proximal and distal ends of a filter case. Partitioning the inside of the enclosed resonant circuits may be performed by a user to form at least a first cavity and a second cavity. The first resonating circuit is then disposed inside the first cavity of the filter case extending from the proximal end towards the distal end, and the second resonating circuit is disposed inside the second cavity also extending from the proximal end towards the distal end. Electrical signals are coupled into the resonating circuits by an encased signal coupler which is removably mounted by a coupling housing for supporting the signal coupler at the proximal end of the filter case for positioning in the vicinity of the resonating circuits.

These and other objects and advantages are realized by high frequency filter design techniques for simplifying the overall specification and prototype processes. The appended claims set forth the features of the present invention with particularity. The invention, together with its objects and advantages, may be best understood from the following detailed description taken in conjunction with the accompanying drawings.

BRIEF DESCRIPTION OF THE DRAWINGS

FIG. 1 is a perspective view from the proximal end of the filter case with a portion of the filter case side walls being cut away to reveal the helical resonator coils and tap coils being housed therein;

FIG. 2 shows the helical filter of FIG. 1 in cross-section;

FIGS. 3*a,* 3*b* and 3*c* show plan and side views of a removable tap housing for supporting, e.g., a tap coil at the proximal end of the filter case in accordance with the present invention;

FIG. 4 is a schematic diagram illustrating a multiple pole helical coil filter providing an input tap and an output tap configuration in accordance with the invention;

FIG. 5 is a schematic diagram illustrating a multiple pole helical coil filter providing loop coupling as an input coupling coil and an output coupling coil configuration in accordance with the invention;

FIG. 6 is a schematic diagram illustrating a multiple pole helical coil filter providing an input capacitive probe and an output capacitive probe configuration in accordance with the invention;

DESCRIPTION OF THE PREFERRED EMBODIMENTS

Figure 7:
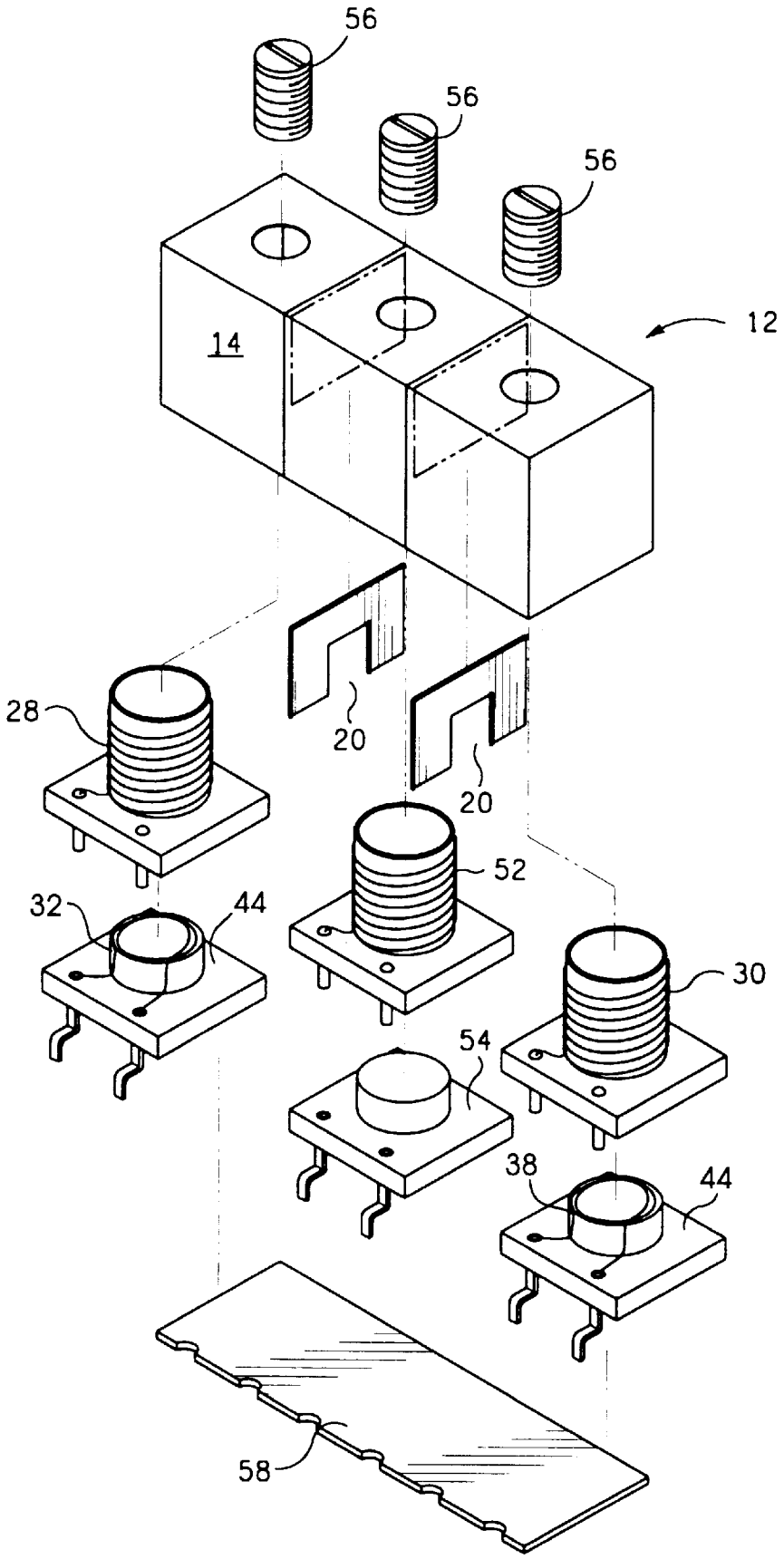
FIG. 7 is an exploded perspective view showing assembly of the filter case, the partitions, the helical resonator coils and the tap coils of a helical filter embodiment.

Reference will now be made in detail to the present preferred embodiments of the invention, examples of which are illustrated in the accompanying drawings relating to circuit design techniques that may be employed in RF and microwave filter (RFMF) prototype kits. The preferred embodiment for a high frequency helical filter 10 is depicted in FIGS. 1 and 2. As discussed further below, a filter case 12 provides an external enclosure having side walls 14, a generally open proximal end 16 and a generally closed distal end 18. A partition 20, herein divider plates, within the filter case 12 separates the inside of the filter case 12 into at least a first cavity 22 and a second cavity 24. The partition has an aperture 26 for coupling the first and second cavities 22 and 24. A first helical resonator coil 28 is disposed inside the first cavity 22 of the filter case 12 extending from the proximal end 16 towards the distal end 18 of said filter case 12, and a second helical resonator coil 30 is disposed inside the second cavity 24 of the filter case 12 which also extends from the proximal end 16 towards the distal end 18 of the filter case 12. The high frequency filter may employ a plurality of removable tuning screws 56 for insertion at the distal end of filter case 12. The tuning screws 56 at the distal end of the filter case 12 at the first cavity and the second cavity respectively provide for tuning of the helical resonator coils. A final shield 58 is provided to cover the open proximal end to minimize the effects of any stray radio frequency radiation or electromagnetic interference (EMI) effects.

As shown in FIGS. 3*a,* 3*b* and 3*c,* a first tap coil 32 is advantageously provided as being connectable in series with the first helical resonator coil 28 at the proximal end 16 of the filter case 12, the series connection 34 between the first helical resonator coil 28 and the first tap coil 32 providing an input tap 36 for coupling electrical signals to the high frequency filter 10. The tap coil 32 is provided with a tap housing 44 having electrical connection pins 48 and 50. A second tap coil 38 (FIG. 2) is also provided as being connectable in series with the second helical resonator coil 30 at the proximal end 16 of the filter case 12, with a second series connection 40 between the second helical resonator coil 30 and the second tap coil 38 providing an output tap 42 for coupling electrical signals from the high frequency filter 10. A first removable tap housing 44 supports the first tap coil 32 at the proximal end 16 of the filter case 12, while a second removable tap 46 housing may be provided for supporting the second tap coil 38 at the proximal end 16 of the filter case 12. Removable tap housings 44 or the like may be used in an intermediate position to support the filter case on a printed circuit board, or for coupling additional electrical signals to the filter e.g., FIG. 7 shows a housing 54 for support and/or for a center tap). This center tap if connected properly could be used for example to couple in a local oscillator signal in addition to merely supporting the center tap portion of the filter on the circuit board.

The filter case 12 is formed of a metal such as aluminum which can be made as a single elongated can, or several smaller cans soldered together. The case 12 has ground conductors provided as part of the metal can housing which can be soldered onto a printed circuit board. The partition 20 may be provided as a permanent part or integral with the case, as where cans are placed together. Alternately, Beryllium copper (BeCu) divider pieces may be employed as partitions 20 instead of multiple cans or cases, which provides multiple possibilities for the partition 20 and the associated aperture 26 separating the inside of the filter case 12 into at least a first cavity 22 and a second cavity 24. The partition has the aperture 26 for coupling the first and second cavities 22 and 24. The combination of varying the helical coils 28, 52, 30, tap coils 32,38 and apertures 26 allows the engineer to achieve the desired filter characteristic provided it is physically achievable. The partitions 20 may be provided as removable partition walls defining the aperture 26 therein, and a kit of multiple partition walls 20 can be provided with each having different sized apertures 26 for varying the signal coupling characteristics between the first cavity 22 and the second cavity 24. Characteristics such as center frequency, bandwidth, input and output impedance, ripple, rejection and others may be varied with the various filter pieces available in the kit. From a relatively small number of pieces a large number of filter permutations may be achieved. Although many filters may not be suitable, the ultimate number of filters which may be achieved will be the multiplication of the number of helical coils by the number of tap coils by the number of apertures in the kit.

The individual filter elements or coils may be provided as helical resonators which may be made using a low loss target material such as polystyrene. A helical cross coupled cavity type filter(60), e.g., FIG. 9, can be produced as well to achieve superior filter characteristics via crosscoupling of resonators cavities.

The kit technique may be extended to other types of RFMF devices. For example, higher frequency combline and waveguide filter kits could be achieved. Also, low frequency simple LC filters can be put into a kit format. Utilizing similar methods of precharacterized filter elements that will correspond to quickly make the filter prototypes discussed herein. The high frequency class of filters may operate to 100 GHz, although most will only operate to 2–3 GHz.

As shown in the presently described embodiment, the first helical resonator coil 28 is disposed inside the first cavity 22 of the filter case 12 extending from the proximal end 16 towards the distal end 18 of the filter case 12, and a second helical resonator coil 30 is disposed inside the second cavity 24 of said filter case 12 which also extends from the proximal end 16 towards the distal end 18 of the filter case 12. Slits are provided in the side of the polystyrene target material of the helical resonators used to form the target material, upon which the helix is wound with slight tension for improved microphonic performance.

Several coupling techniques may be employed for coupling electrical signals into and between the resonant cavities of the RF filters described herein. With reference to FIG. 4 is a schematic diagram illustrates a multiple pole helical coil filter providing an input tap 36 and an output tap 42 configuration. FIG. 5 is a schematic diagram illustrating a multiple pole helical coil filter providing loop coupling an input coupling coil and an output coupling coil configuration. The loop should be physically close to the helical coil to facilitate the loop coupling. FIG. 6 is a schematic diagram illustrating a multiple pole helical coil filter providing an input capacitive probe and an output capacitive probe configuration. Probe coupling may be achieved via a microstrip circuit board placed at the proximal end of the case 12 with a mechanical coupling arrangement of the case 12 to the printed circuit board (PCB) which provides the microstrip circuitry. The PCB employing probe coupling may also be used to match impedance's to the circuitry outside the filter. Other known signal coupling techniques also may be used, depending upon the type of resonators being employed in the filter designs.

The high frequency filter shown in FIGS. 3*b* and 3*c* provides the tap housing as including a potting material for encasing the tap coils. The tap housing 44 may then position the respective tap coils inside the respective helical resonator coils to facilitate signal coupling. The potting material or plastic should be formed from a low loss tangent material, such as polyethylene, which also is capable of withstanding the heat dissipation of soldier applications. FIG. 7 shows an exploded perspective view showing assembly of the filter case, the partitions, the helical resonator coils and the tap coils of a helical filter embodiment.

When the described tap housing 44 is provided as a plastic material for encasing the tap coils, color coding of the plastic housing potting materials may be used as indicia for indicating inductance values and the like. Other indicia such as printed text or symbols also may be employed to show and identify the values associated with the various resonant elements. As described, the housing electrically couples or connects the first tap coil with the first helical resonator coil at the series connection between the first tap coil and the first helical resonator respectively to facilitate the desired coil tap function. The tap housing 44 may include a metallic coupling, such as a BeCu socket having a brushing action, for electrically connecting the tap coils with the helical resonator coils at the series connection between the tap coil and the helical resonator respectively, while providing a good electrical contact for the tap connection. No soldering is required because the tap point uses the BeCu brushed socket, and the coupling between helical coils may be achieved through the use of capacitive coupling, as discussed. Samtec USA surface mount sockets SC/SK/SP series were acceptable for this purpose, although any known sockets may be employed for use with the described tap housing connection. Thus the tap housing provides an electrical socket for electrically connecting the tap coils with the helical resonator coils at the series connection between the tap coil and the helical resonator. Use of the sockets allows for rapid prototyping of various filter designs, and since no soldering is required, filter configurations may be modified until the correct response is achieved.

Figure 8:
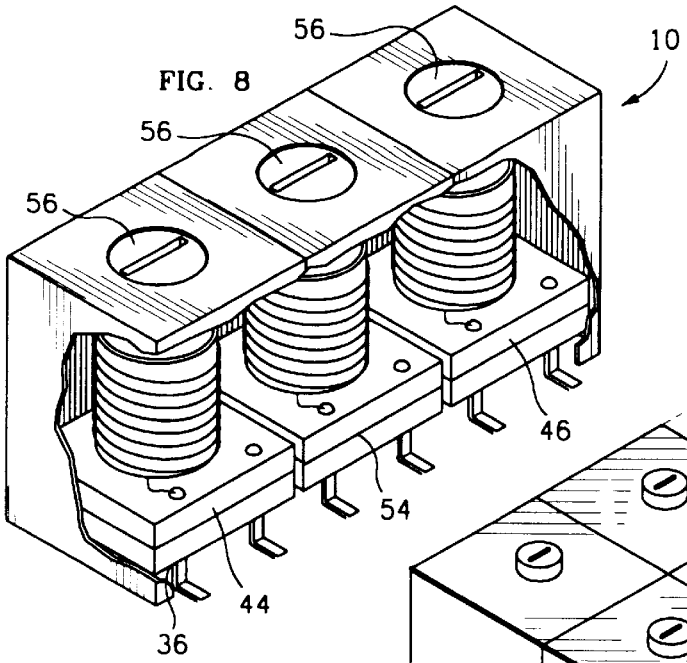
FIG. 8 is a perspective view of the filter case with a portion of the filter case side walls being cut away to reveal the helical resonator coils and tap coils.
Figure 9:
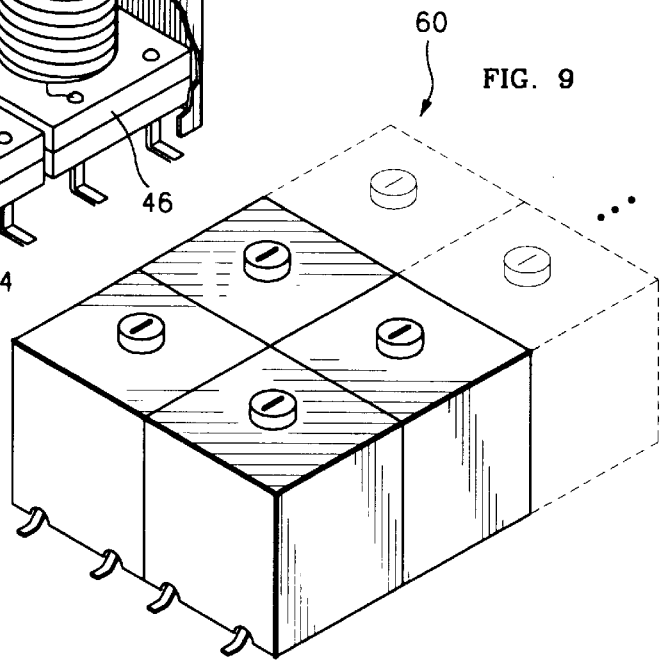
FIG. 9 is a perspective view of a cross coupled cavity resonator embodiment.

As illustrated in the exploded view of FIG. 7 and the assembly shown in FIG. 8, a first tap coil 32 is advantageously provided as being connectable in series with the first helical resonator coil 28 at the proximal end 16 of the filter case 12, the series connection 34 between the first helical resonator coil 28 and the first tap coil 32 providing an input tap 36 for coupling electrical signals to the high frequency filter 10. FIG. 9 is a perspective view of a cross coupled cavity resonator embodiment, whereas FIG. 8 shows a multipole helical filter embodiment. FIG. 8 shows a alternate embodiment of the invention in the form of a vertical surfacemount filter. The cross coupled cavity filter of FIG. 9 can expand to 4, 6, 8,10 . . . poles, etc. The plastic material for the tap housing 44 of the tap coils may be made with pins for surface mounting or through pins may be provided, as required for specific applications. The connector pins may thus include surface mount connector pads.

The second tap coil 38 is also provided as being connectable in series with the second helical resonator coil 30 at the proximal end 16 of the filter case 12, with a second series connection 40 between the second helical resonator coil 30 and the second tap coil 38 providing an output tap 42 for coupling electrical signals from the high frequency filter 10. Removable tap housings 44 and 46 support the first tap coil 32 and the second tap coil 38 at the proximal end 16 of the filter case 12. The second removable tap 46 housing may be provided for supporting the second tap coil 38 at the proximal end 16 of the filter case 12. The removable tap housings may be provided with internal BeCu brushes or socket pins for good electrical contacts.

Figure 10:
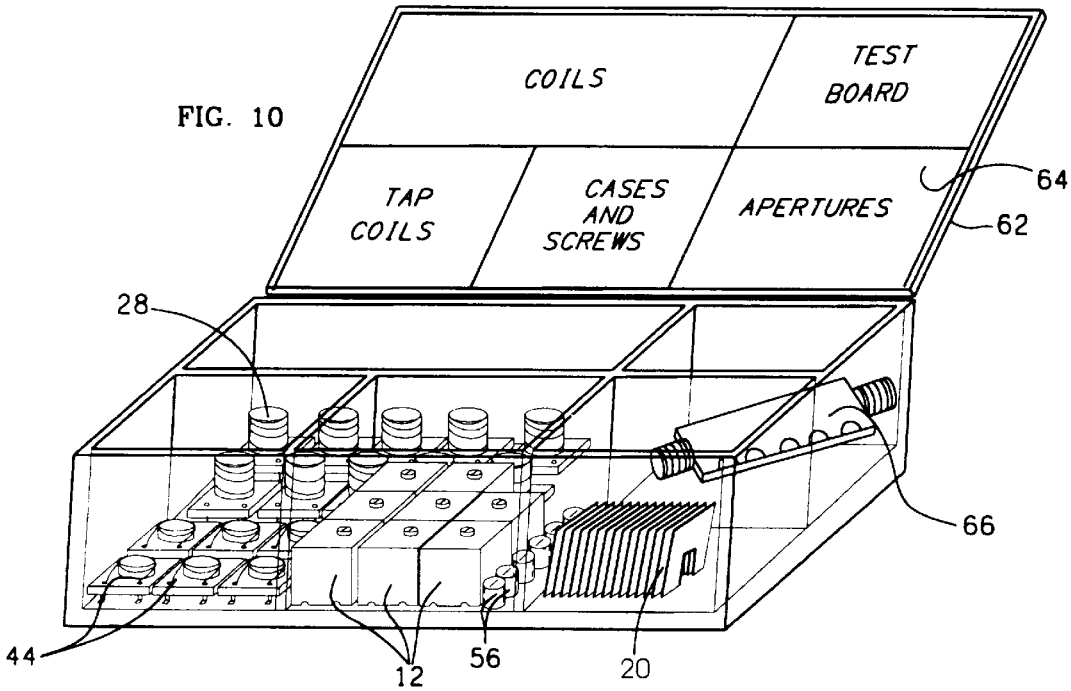
FIG. 10 shows a kit for assembling a high frequency filter by specifying the basic components required to build the specific high frequency filter, allowing the user to build prototype or final use filters.

Various filter kits with the numerous standardized and characterized components as discussed herein may be provided to include a multiplicity of the first tap coils encased in the tap housings for varying signal coupling characteristics between the first tap coil 32 and the first helical resonator coil 28. Filters may be created from about 5 MHz to 100 GHz although most will be from 50 MHz to 3 GHz. Helical filters generally operate from about 50 MHz to 3 GHz. Various kits will address characteristics of various bands. Such as one kit from 100 MHz to 500 MHz another from 500 MHz to 1000 MHz, and so on. Kits with various taps and partitions (e.g., 3 to 10 pieces) may be provided for various bandwidth, e.g., 5% to 20%. As shown in FIG. 10, the kit may include several (e.g., 20 to 100) helical coils to cover a wide range of frequencies, e.g., 50 MHz to 1600 MHz.

The sub-component parts of filter kits, may include:

1) Rectangular metal shield of various sizes;
2) Helical Coil and or Inductor pieces;
3) Coupled Cavity divider pieces;
4) Inductive and Capacitively couple end pieces;
5) Various tuning pieces; and
6) Test boards.

Software may be used which corresponds with the components of the kits which allows the designer to take a filter from frequency characteristics to a matrix of required physical components. Software also may be provided for generating the filter characteristic information from the filter component data with a very close approximation to the actual prototype. This can be done verses other existing filter software because the piece parts will be very well characterized. Thus software output may be accurate for building and simulation purposes. This software could be accessable via a web site on the internet. A manual may also be included which would contain various filters characteristics corresponding to various combinations of kit pieces.

As described above, the kit which is shown in FIG. 10 may be used by the circuit designer to provide a quick method of assembling a high frequency filter prototypes, by providing coils for resonating electrical, and enclosing at least first and the second coils between a generally open proximal end and a generally closed distal end. Additional coils may be used for additional filter poles in multiple pole filter applications. The designer then partitions the enclosed first and second coils into a first cavity and a second cavity respectively. The first coil inside the first cavity extends from the proximal end towards the distal end, and the second coil inside the second cavity extends from the proximal end towards the distal end of the enclosure. Then a signal coupler such as the described tap coil is provided for coupling electrical signals into the coils. The tap coil may encase the signal coupler in a coupler housing such as the tap housing discussed above for removably positioning the signal coupler in the vicinity of the resonant coils. The coupler housing is thus supported at the proximal end of the filter case. By providing various combinations of helical resonators in the embodiment of FIG. 10, e.g., the helical coils 28, the partitions 20, the tap coils 44, tuning screws 56, enclosure 12, testboard 66, numerous filter combinations may be rapidly assembled. Through the appropriate choice of component parts, a kit may be made to cover a wide range of frequencies, e.g., 50 MHz to 1600 MHz with bandwidths of approximately 5% to 20%. This is useful for the prototyping, experimentation and production for a wide variety of RF and Microwave system designs.

It will be appreciated by those skilled in the art the modifications to the foregoing preferred embodiment may be made in various aspects. The present invention is set forth with particularity in the appended claims. It is deemed that the spirit and scope of that invention encompasses such modifications and alterations to the preferred embodiment as would be apparent to one of ordinary skill in the art and familiar with the teachings of the present application.

What is claimed is:

1. A high frequency filter, comprising:

a filter case having side walls, a generally open proximal end and a generally closed distal end;

a partition within said filter case for separating the inside of said filter case into at least a first cavity and a second cavity, said partition having an aperture for coupling the first and second cavities;

a first helical resonator coil disposed inside the first cavity of said filter case extending from the proximal end towards the distal end of said filter case;

a second helical resonator coil disposed inside the second cavity of said filter case extending from the proximal end towards the distal end of said filter case;

a first tap coil connectable in series with said first helical resonator coil at the proximal end of said filter case, the series connection between said first helical resonator coil and said first tap coil providing an input tap for coupling electrical signals to the high frequency filter;

a second tap coil connectable in series with said second helical resonator coil at the proximal end of said filter case, the series connection between said second helical resonator coil and said second tap coil providing an output tap for coupling electrical signals from the high frequency filter; and a removable tap housing for supporting said first tap coil at the proximal end of said filter case wherein said tap housing comprises an electrical socket for electrically connecting said first tap coil with said first helical resonator coil at the series connection between said first tap coil and said first helical resonator.

2. A high frequency filter as recited in claim 1, wherein said tap housing encases said first tap coil for mounting said first tap coil in the vicinity of said first helical resonator coil.

3. A high frequency filter as recited in claim 2, comprising a kit including a multiplicity of said first tap coils encased in a multiplicity of said tap housings for varying signal coupling characteristics between said first tap coil and said first helical resonator coil.

4. A high frequency filter as recited in claim 2, wherein said tap housing comprises an electrical coupling for circuit connections to the high frequency filter.

5. A high frequency filter as recited in claim 4, wherein said electrical coupling comprises surface mount connector pads.

6. A high frequency filter as recited in claim 2, wherein said tap housing comprises a potting material for encasing said first tap coil.

7. A high frequency filter as recited in claim 2, wherein said tap housing comprises a plastic material for encasing said first tap coil.

8. A high frequency filter as recited in claim 1, wherein said tap housing comprises means for electrically connecting said first tap coil with said first helical resonator coil at the series connection between said first tap coil and said first helical resonator.

9. A high frequency filter as recited in claim 1, wherein said tap housing comprises a metallic coupling for electrically connecting said first tap coil with said first helical resonator coil at the series connection between said first tap coil and said first helical resonator.

10. A high frequency filter as recited in claim 1, comprising a second removable tap housing for mounting said second tap coil at the proximal end of said filter case for positioning said second tap coil in the vicinity of said second helical resonator coil.

11. A high frequency filter as recited in claim 1, comprising a first tuning screw at the distal end of said filter case at the first cavity and a second tuning screw at the distal end of said filter case at the second cavity respectively for tuning said first and said second helical resonator coils.

12. A high frequency filter, comprising:

a filter case having side walls, a generally open proximal end and a generally closed distal end;

a partition within said filter case for separating the inside of said filter case into at least a first cavity and a second cavity, said partition having an aperture for coupling the first and second cavities;

a first helical resonator coil disposed inside the first cavity of said filter case extending from the proximal end towards the distal end of said filter case;

a second helical resonator coil disposed inside the second cavity of said filter case extending from the proximal end towards the distal end of said filter case;

a first tap coil connectable in series with said first helical resonator coil at the proximal end of said filter case, the series connection between said first helical resonator coil and said first tap coil providing an input tap for coupling electrical signals to the high frequency filter;

a second tap coil connectable in series with said second helical resonator coil at the proximal end of said filter case, the series connection between said second helical resonator coil and said second tap coil providing an output tap for coupling electrical signals from the high frequency filter; and a removable tap housing for supporting said first tap coil at the proximal end of said filter case wherein said tap housing comprises an electrical socket for electrically connecting said first tap coil with said first helical resonator coil at the series connection between said first tap coil and said first helical resonator, wherein said tap housing positions said first tap coil inside said first helical resonator coil.

13. A high frequency filter as recited in claim 12, wherein said partition comprises a removable partition wall defining an aperture therein.

14. A high frequency filter as recited in claim 13, wherein said partition comprises said removable partition wall comprising a kit of multiple partition walls each having different sized apertures for varying signal coupling characteristics between the first cavity and the second cavity.

15. A high frequency filter as recited in claim 12, wherein said tap housing encases said first tap coil for mounting said first tap coil in the vicinity of said first helical resonator coil.

16. A high frequency filter as recited in claim 15, comprising a kit including a multiplicity of said first tap coils encased in a multiplicity of said tap housings for varying signal coupling characteristics between said first tap coil and said first helical resonator coil.

17. A high frequency filter as recited in claim 15, wherein said tap housing comprises an electrical coupling for circuit connections to the high frequency filter.

18. A high frequency filter as recited in claim 17, wherein said electrical coupling comprises surface mount connector pads.

19. A high frequency filter as recited in claim 15, wherein said tap housing comprises a potting material for encasing said first tap coil.

20. A high frequency filter as recited in claim 15, wherein said tap housing comprises a plastic material for encasing said first tap coil.

21. A high frequency filter as recited in claim 12, wherein said tap housing comprises means for electrically connecting said first tap coil with said first helical resonator coil at the series connection between said first tap coil and said first helical resonator.

22. A high frequency filter as recited in claim 12, wherein said tap housing comprises a metallic coupling for electrically connecting said first tap coil with said first helical resonator coil at the series connection between said first tap coil and said first helical resonator.

23. A high frequency filter as recited in claim 12, comprising a second removable tap housing for mounting said second tap coil at the proximal end of said filter case for positioning said second tap coil in the vicinity of said second helical resonator coil.

24. A high frequency filter as recited in claim 12, comprising a first tuning screw at the distal end of said filter case at the first cavity and a second tuning screw at the distal end of said filter case at the second cavity respectively for tuning said first and said second helical resonator coils.

* * * * *